US007198432B2

(12) United States Patent
Chen

(10) Patent No.: US 7,198,432 B2
(45) Date of Patent: Apr. 3, 2007

(54) WATER RESOURCE RECYCLING SYSTEM

(76) Inventor: Jui Wen Chen, P.O. Box 82-144, Taipei (TW)

( * ) Notice: Subject to any disclaimer, the term of this patent is extended or adjusted under 35 U.S.C. 154(b) by 0 days.

(21) Appl. No.: 10/301,696

(22) Filed: Nov. 22, 2002

(65) Prior Publication Data

US 2004/0099414 A1 May 27, 2004

(51) Int. Cl.
*E02B 11/00* (2006.01)

(52) U.S. Cl. ..... 405/50; 405/43; 405/45; 405/36; 405/53; 405/52

(58) Field of Classification Search ..... 405/50, 405/43–46, 36, 41, 52, 53
See application file for complete search history.

(56) References Cited

U.S. PATENT DOCUMENTS 3,667,236 A * 6/1972 Rosene ..... 405/50
3,837,168 A * 9/1974 Alsberg et al. ..... 405/50
5,064,308 A * 11/1991 Almond et al. ..... 405/43
5,183,355 A * 2/1993 Treat et al. ..... 405/50
6,962,464 B1 * 11/2005 Chen ..... 405/43

* cited by examiner

*Primary Examiner*—Frederick L. Lagman
(74) *Attorney, Agent, or Firm*—Leong C. Lei

(57) ABSTRACT

A water resource recycling system includes an environmental permeable flooring which allows the rain on the ground be accumulated and quickly permeate into the underground. A vertical overflow duct is drilled deep into the permeable stratum under the ground to further draw the rain through the impermeable (clay) stratum to the deeper groundwater stratum. A plurality of water reservoirs pre-buried under the ground nearby the vertical overflow duct are connected to the vertical overflow duct, thereby as the rain permeated from the ground surface to the vertical overflow duct becomes saturated, the rain will flow to the water reservoirs of different size. Each water reservoir is connected to a water-drawing pipe extended to the ground surface such that the rain can be completely absorbed and stored by the earth for preventing heat island effect.

9 Claims, 7 Drawing Sheets

WATER RESOURCE RECYCLING SYSTEM

FIELD OF THE INVENTION

The present invention relates to a water resource recycling system, particularly to a design provided on the ground surface, which is permeable such that the rain can be drawn into the underground to enhance the hydrous content of the soil, while the overflow water may be drawn to the groundwater stratum by the vertical drainpipe deeply drilled into the underground and be stored in the water reservoir after being filtered for an urgent need of water some day.

BRIEF DESCRIPTION OF THE PRIOR ART

Generally, a concrete flooring according to the prior art is constructed by pouring a sufficient amount of concrete on the ground, paving the ground surface to flat and applying brick tiles. Given that concrete is impermeable and that the water on the brick tile surface cannot permeate into the soil under the concrete, a great amount of water would accumulate on the ground after a rush of rain, rendering flood disasters easily.

Besides, according to some research, if the rain cannot permeate into the soil after a long period of time, it will result in a heat island effect in the city and, in turn, affect the health of the people.

Meanwhile, as the rain cannot permeate into the ground soil, the groundwater will dry up due to not being supplemented. Accordingly, water resource protection has become an extremely import issue in many countries. There exists a need in efficiently solving the problem.

SUMMARY OF THE INVENTION

The primary object of the present invention is to provide a water resource recycling system which includes a highly permeable environmental concrete flooring which is applied to the ground surface so as to reduce the chances of water accumulation on the ground surface and recycle the rain completely.

The secondary object of the present invention is to provide a water resource recycling system which may draw the permeated water deep into the groundwater stratum to enrich the groundwater content and prevent the groundwater stratum from sagging due to the dried-up of the groundwater.

Another object of the present invention is to provide a water resource recycling system which has a vertical overflow duct extended deep into the groundwater stratum. The vertical overflow duct is connected to the water reservoirs of different water level such that the overflow in the vertical overflow duct can flow into each water reservoir and stored therein for future use on the ground surface by way of mechanical drawing.

For the above purposes, the water resource recycling system according to the present invention is characterized in that:

1. a vertical overflow duct extending deep into the impermeable (clay) stratum is provided by way of digging through the macadam base, and permeable and/or fast water-drawing materials such as pebbles, sands, etc. can be filled in the vertical overflow duct;
2. water reservoirs of different water level are pre-buried nearby the vertical overflow duct and are respectively connected to the vertical overflow duct on the upper level portion by connecting pipes in which sand filters are provided;

3. water-drawing pipes are provided for connecting the water reservoirs and the ground, thereby drawing the water stored in the water reservoirs to the ground surface; and
4. a plurality of drainpipes are buried under the permeable flooring constructed by environmental permeable concrete and through to the permeable soil stratum.

Given the above characteristics, the constructed flooring permits the rain on the concrete flooring be drawn into the underground and completely recycled as a resource. Not only the heat island effect can be prevented due to the increase of the water content in the soil, but also the groundwater can be stored in the water reservoirs pre-buried under the ground for the need in a draught or any urgent time.

The detailed construction and other characteristics of the present invention can be better understood by way of reading the following descriptions with reference to the accompanied drawings.

DESIGNATED NUMBERS OF THE ELEMENTS

Figure 1:
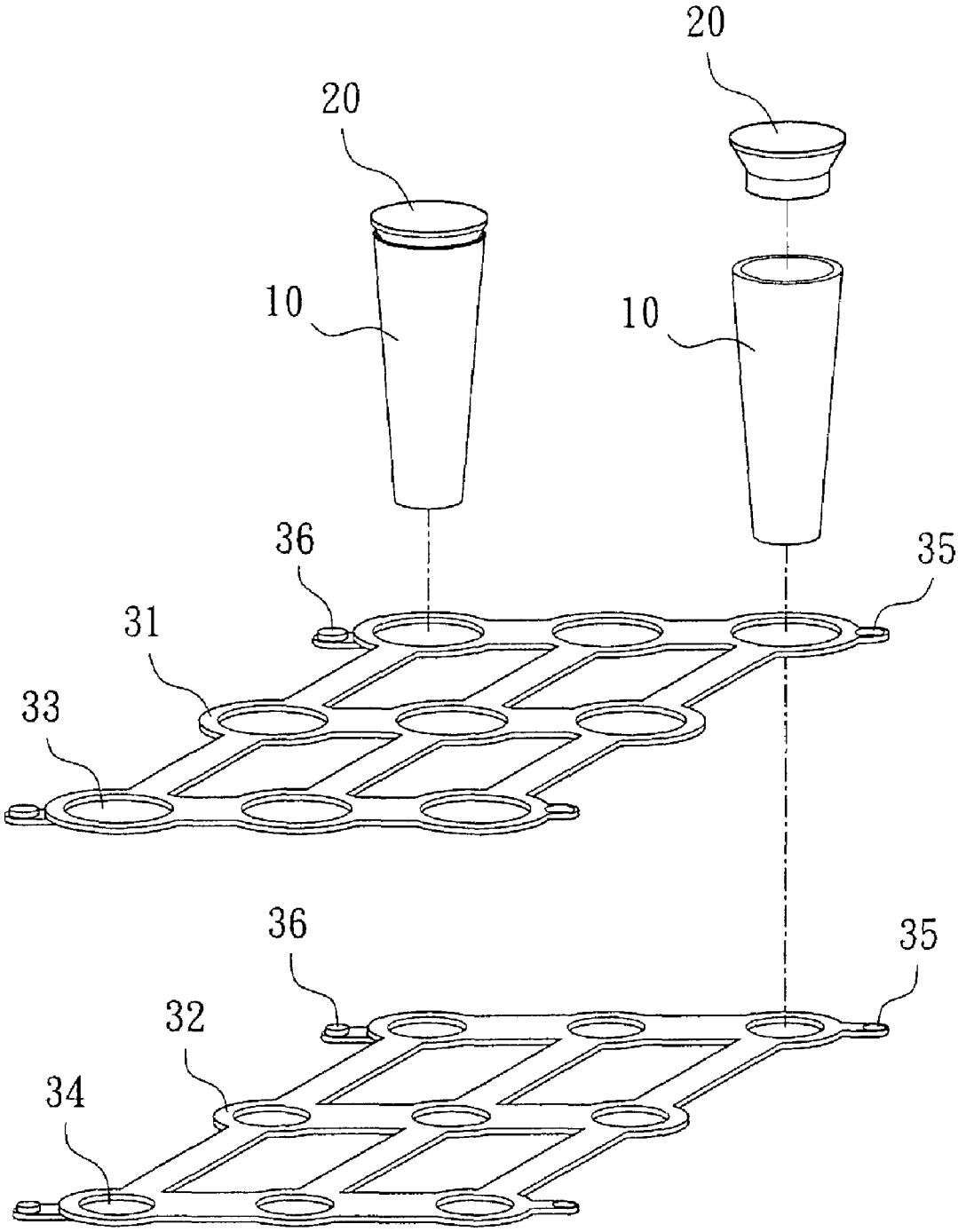
FIG. 1 is an exploded view of the drainpipe unit for constructing the permeable flooring according to the invention.

10 . . . drainpipe
20 . . . sealing plug
31 . . . frame unit
32 . . . frame unit
35 . . . coupling collar
36 . . . coupling button
41 . . . concrete
42 . . . sand/macadam layer
43 . . . macadam base
44 . . . permeable soil stratum
45 . . . impermeable (clay) stratum
50 . . . formwork
51 . . . grille
62 . . . filtering net
63 . . . intake cap
64 . . . intake
65 . . . sand filtering element
66 . . . outlet
67 . . . dredging pipe
68 . . . uppercap
70 . . . vertical overflow duct
**70*a*** . . . pipe
71 . . . stones

72, 72*a* . . . shallow level water reservoir
72, 73*a* . . . deep level water reservoir
74 . . . filter
75 . . . water-drawing pipe
76 . . . uppercap
76*a* . . . air-vents
77 . . . drainpipe
78 . . . intakes
79 . . . sand filtering element
80 . . . capillary drainpipe band
81 . . . pipeline
82 . . . seam
83 . . . drainpipe row

DETAILED DESCRIPTION OF THE EMBODIMENTS

The special construction of the present invention includes applying a permeable flooring on the ground or reprocessing the impermeable flooring by drilling the drainpipes into the underground, so that the rain can permeate into the underground and be corrected for further use. For example, the construction of a permeable concrete flooring according to the invention includes the following steps.

As shown in FIG. 1, a drainpipe unit is formed by a plurality of hollow drainpipes 10, sealing plugs 20, frame units 31, 32; each frame unit has coupler collars 35 and coupler buttons 36 for coupling the frame units one by one.

Figure 2:
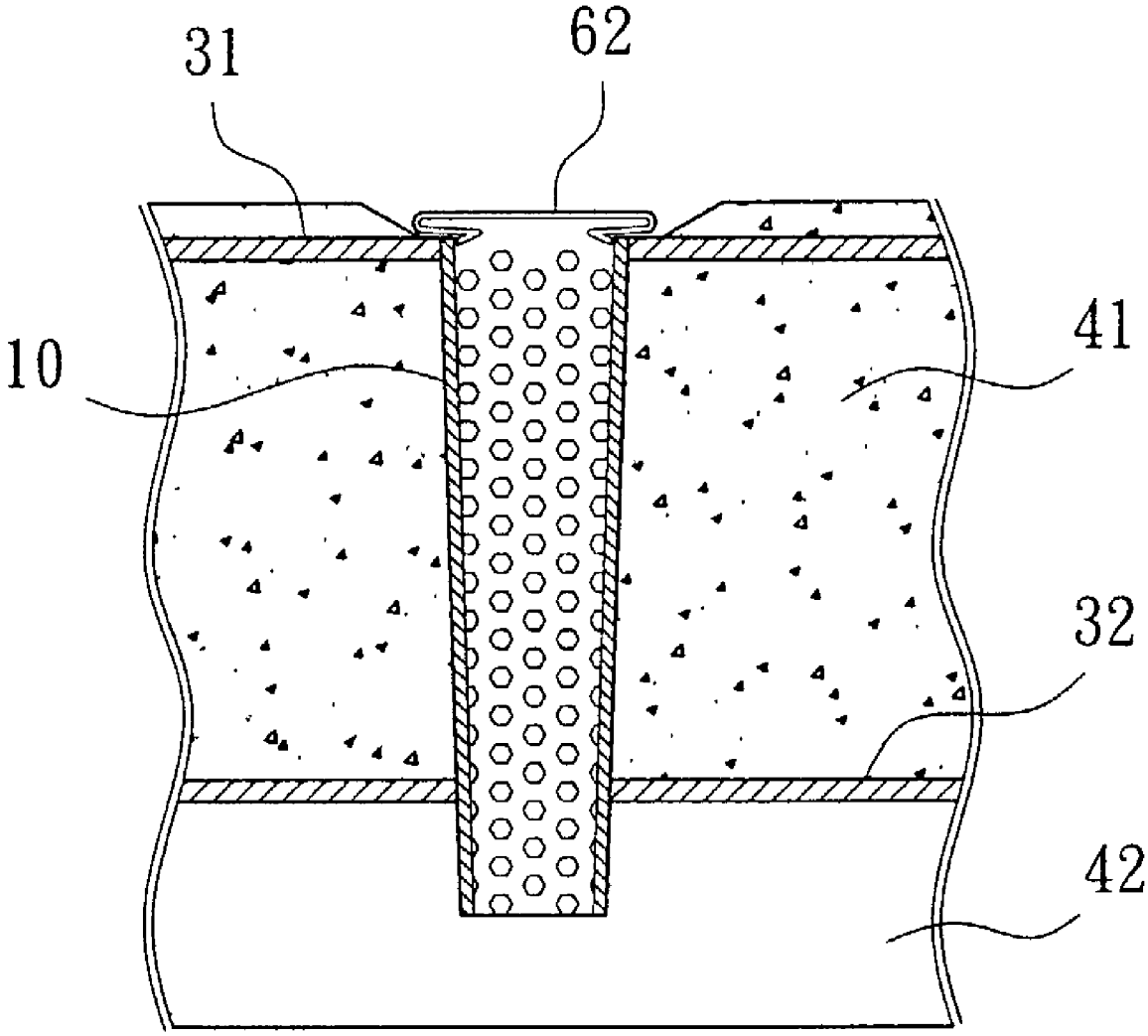
FIG. 2 is a sectional view of the concrete flooring according to the invention.

As shown in FIG. 2, according to an embodiment of the invention, the drainpipe units are applied to the ground to be constructed, preferably the combined drainpipe units are applied to the highly permeable sand/macadam layer 42 which was pre-applied to the macadam base, and then the concrete 41 is applied to the ground to cover the drainpipe units. After removing the sealing plugs 20, if necessary, filtering nets 62 can be mounted on the drainpipes to prevent shoe heels from falling into the pipe. The permeable flooring construction is accomplished as the concrete is dried and solidified.

Figure 3:
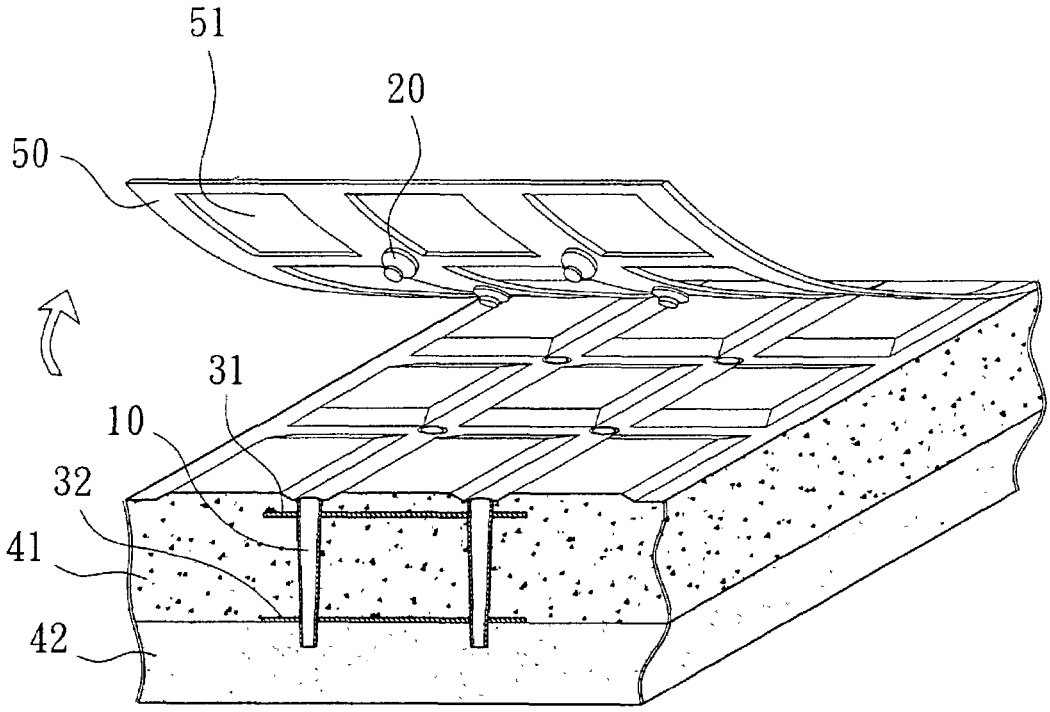
FIG. 3 is a schematic view of the formwork construction according to the invention.

Now refer to FIG. 3, to make the construction of the environmental permeable flooring more effective, a formwork 50 can be combined with the sealing plugs 20 such that the slurry would not flow into the drainpipes 10 and upon paving the concrete, water-collecting grooves will form in ground after removing the sealing formworks 50. Therefore, by combining the above formworks, the construction time and cost are significantly reduced.

To speed construction of the environmental permeable flooring according to the invention, sealing plugs 20 may be pre-inserted to the opening of the hollow pipes 10 in the plant, so as to prevent the concrete or other materials from entering into and being blocked in the pipes 10 at the time of construction. The sealing plugs 20 can be made of paper materials and adhered to the sealing formworks 50 by adhesive, whereas the sealing formworks 50 can be made of plastic film and combined with the sealing plugs 20 by automatic hot pressing. Furthermore, the sealing formworks 50 and the sealing plugs 20 can be made integrally and formed of high pressure injected plastic to become a sort of sealing formwork having a plurality of grilles 51, so that the concrete can be poured on the ground to form a flooring configuration. After the concrete flooring is accomplished, the sealing formworks can be removed, thereby speeding the construction and achieving the water drawing effect of the flooring.

As mentioned above, the drainpipe units of the permeable flooring according the invention include pipes 10 with a taper (or with fastening rings provided on the outer diameter), a upper frame 31 and a lower frame 32 respectively provided with holes to receive the pipes 10. Each hole has a diameter to match with the upper and lower diameters of the pipes 10 such that the pipes can be steadily engaged in the frame units. Besides, the sealing formworks 50 can be made of paper materials and adhered to the sealing plugs 20 by adhesive. Alternatively, the sealing formworks 50 can be made of plastic materials and formed integrally with the sealing plugs. The application of the drainpipe units to the ground to be constructed mainly includes the following steps: a) inserting the bottom end of drainpipes into the soil or pre-paving the sand/macadam layer 42; b) pouring concrete 41 on the ground; and c) removing the sealing formworks 50 (as shown in FIG. 3) after the concrete is solidified, and a permeable concrete flooring is easily accomplished.

Figure 4:
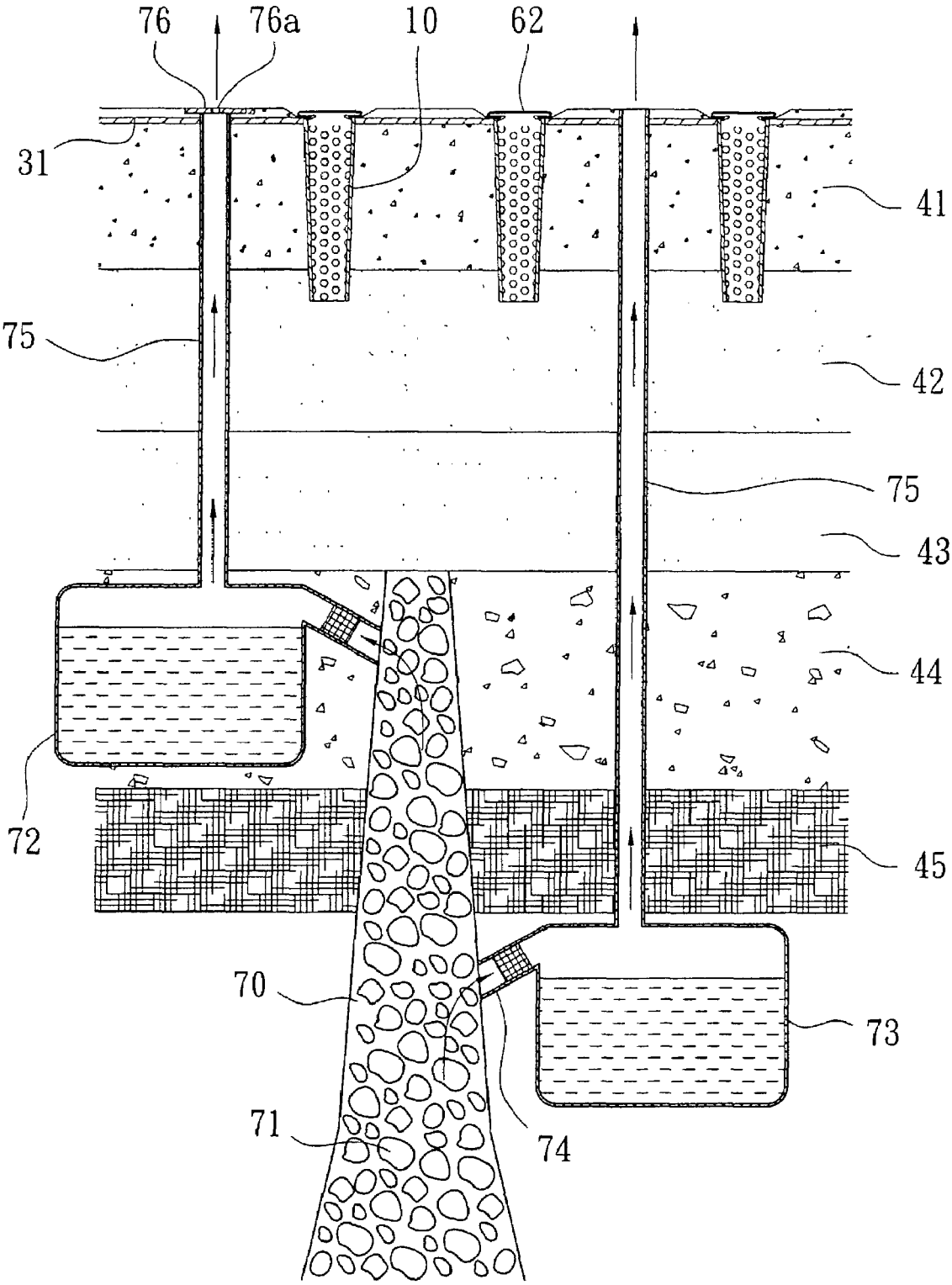
FIG. 4 is a sectional view of the water resource recycling system according the invention.

Further refer to FIG. 4, in the water resource recycling system according to the invention, the vertical overflow duct 70 is pre-drilled deep into the macadam base 43 before the permeable flooring is applied to the ground. The drilling engineering includes drilling the vertical overflow duct 70 deep into the macadam base 43 as shown, further drilling the vertical overflow duct 70 through the permeable soil stratum 44 and impermeable (clay) stratum 45, directly filling in the vertical overflow duct 70 stones 71 of different size (or other materials allowing water to permeate therebetween) and sand with well water-drawing characteristic so as to have the water filtered and prevent the soil from filling in the duct, pre-burying a shallow level water reservoir 72 and/or a deep level water reservoir 73 nearby the vertical overflow duct 70 or under the permeable soil stratum 44, on the upper level of each water reservoir being connected to the vertical overflow duct by a pipe and inside of the duct is stuffed with filter 74 of permeable cotton or non-woven fabric in order to prevent sand and pebbles from entering into the water reservoirs.

Accordingly, when the a great amount of rain permeates into the vertical overflow duct 70, the overflowed rain in the macadam base 43 may be drawn deep into the underground or the groundwater stratum quickly, and if the collected water is too much, the filtered water will flow upward to the water reservoirs of different depth through to the vertical overflow duct 70, and be stored in the shallow level water reservoir 72 or the deep level water reservoir 73 for future use. Each water reservoir is connected to the ground surface by a water-drawing pipe 75 and provided on the outlet end of the water-drawing pipe a cap 76 which may have air-vents 76*a* for ventilating air out of the water reservoirs.

Therefore, when a great amount of rain accumulates in an area, it can be drained into the underground by the drainpipes, and permeates into the soil by the permeable flooring according to the invention, so as to prevent the city from floods and the groundwater stratum from dry up, as well as the stratum from sagging. Furthermore, the groundwater can be drawn into the overflow duct and stored in the water reservoirs for future use, for example, when in draught, the stored water can be drawn to the ground surface by the drawing pipes. And as the macadam base properly absorbs the rain to reach certain water content, the heat island effect can be prevented.

Figure 5:
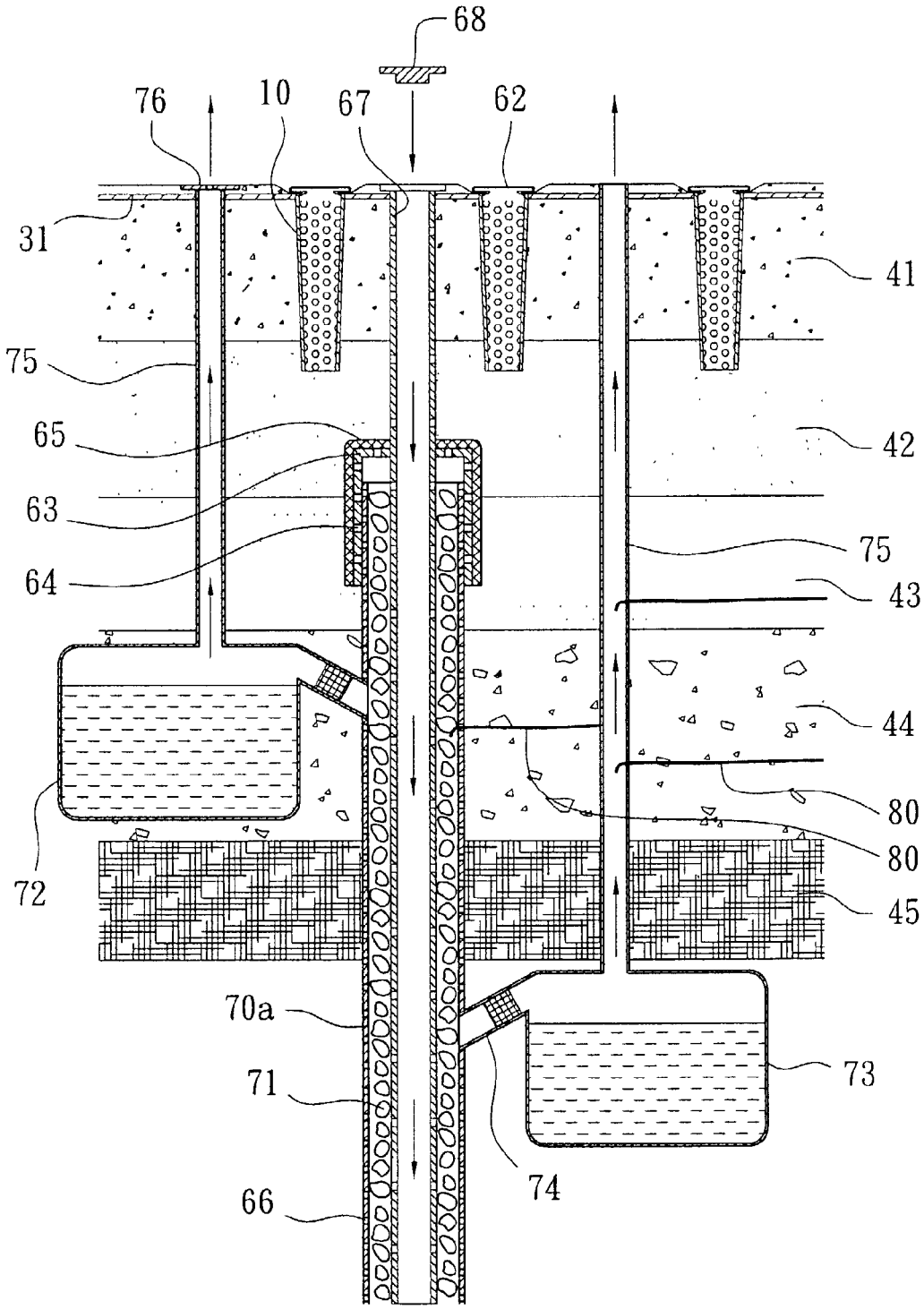
FIG. 5 is a sectional view of the water resource recycling system according to an embodiment of the invention.

FIG. 5 shows an embodiment of the present invention, wherein a vertical overflow duct 70*a* presents a great tube made of plastic, metal or concrete and is pre-buried in the macadam base 43 for obtaining better permeation. Above the duct 70*a* is provided a water-collecting cap 63 which has intakes 64. The intakes 64 are covered by sand filtering elements 65 such that the water can be quickly drawn into the overflow duct 70*a*. The vertical overflow duct 70*a* has water outlets 66 for drawing the water deep into the underground to supplement the groundwater content.

Also, as the intakes 64 on the water collecting cap 63 might be blocked after a period of time, a dredging pipe 67 with a upper cap 68 may be extended along the inner side of the upper vertical overflow duct 70*a* and above the water collecting cap 63, so that when in maintenance, the worker may remove the upper cap 68, insert a high pressure water injecting hose and flush the dredging pipe 67 with high pressure water. As the dirt blocked in the outlets 66 of the dredging pipe 67 has been flushed away, the permeation of the overflow duct can be ensured.

To achieve better water drawing, the space between the vertical overflow duct 70*a* and the dredging pipes 67 can be left empty as a well pipe deep into the ground without filling in any filtering stones or other artificial permeable materials such that the water can be lead quickly.

Again refer to FIG. 5, the invention can further use capillary drainpipe band 80 or drainpipes and/or permeable materials of other type which are pre-buried in the macadam base 43 or the sand/macadam layer 42. The capillary drainpipe band 80 is connected to the pipe 70*a* of the vertical overflow duct or drainpipe 75 such that the saturated water in respective layers can be drained quickly into the pipes to prevent stratum from becoming sludgy and/or sagging due to accumulation of heavy water.

Figure 6:
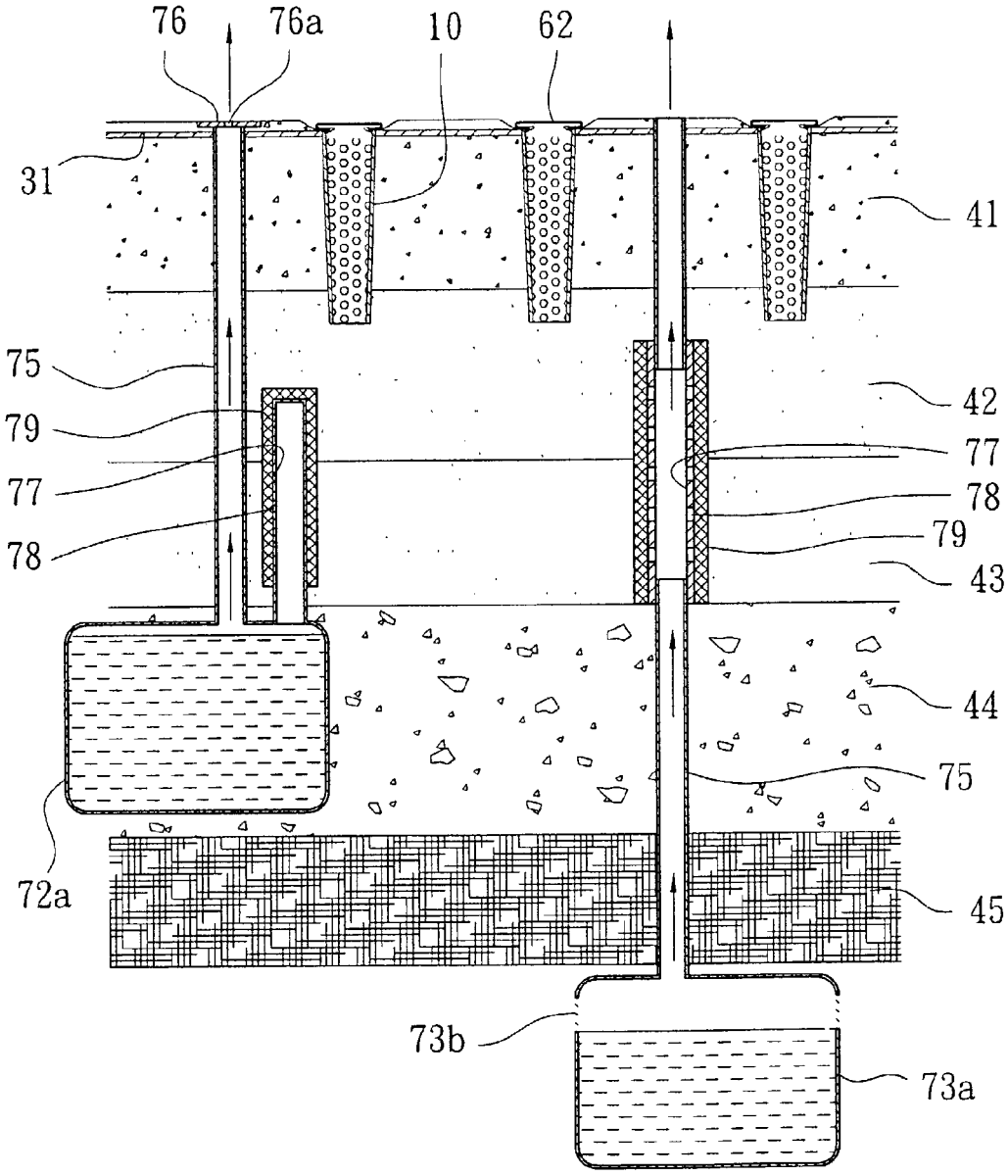
FIG. 6 is a sectional view of the water resource recycling system according to another embodiment of the invention.

FIG. 6 shows another embodiment of the invention which does not have a vertical overflow duct. Instead, a shallow level water reservoir 72*a* and/or a deep level water reservoir 73*a* are provided in the macadam base 43. A drainpipe 77 is provided on the upper level of each water reservoir. And the drainpipe 77 has intakes 78 which are covered by sand filtering elements 79 such as non-woven fabric, filtering cotton or the like, so that only water can be drawn from the macadam base into the water reservoirs.

Besides, overflows 73*b* may be provided on the upper level of the deep level water reservoir 73*a*, so that the water can overflow to supplement the groundwater resource.

As shown, the embodiments according to the invention may alternatively have short conduits 77 which may be connected to drainpipe 75 to have the same function of water drawing.

Figure 7:
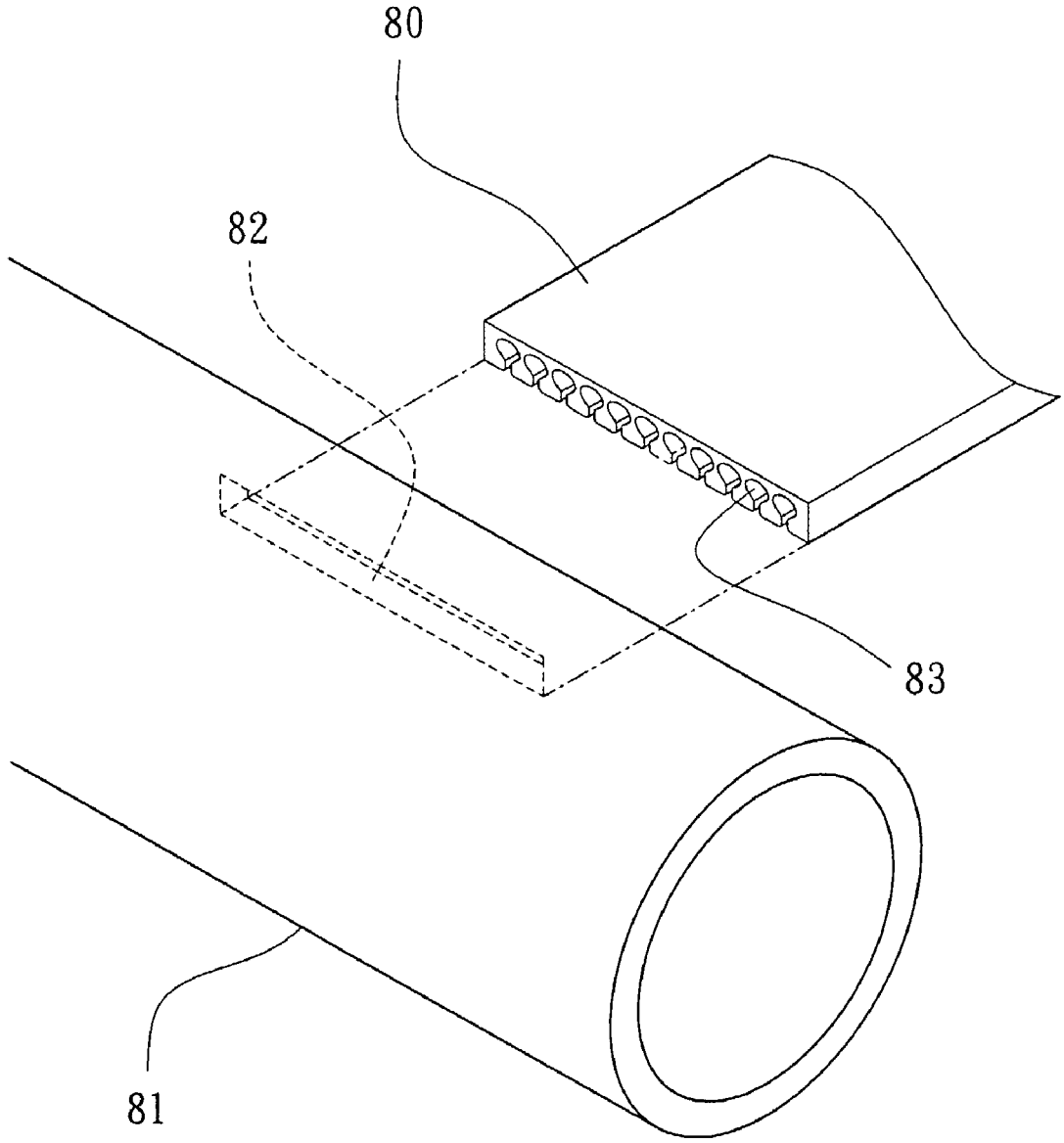
FIG. 7 is a schematic view of the capillary drainpipe band construction according to the invention.

As shown in FIG. 7, when being applicable to the invention, the capillary drainpipe band 80 is used with pipeline 81 which is cut to form a seam 82 on the pipe body. The capillary drainpipe band 80 is provided through to the seam 82, and by the drainpipe row 83 constructed in the capillary drainpipe band 80, the water can be drained out. The capillary drainpipe band can be applied in soil preparation and underground drainage engineering for the purposes of accomplishing an underground water draining design, and subsequently reducing the ground surface scrubbing, as well as storing water resource. When applying the capillary drainpipe band, the following should be noted:

(1) The depth of the capillary drainpipe band provided shall depend on the groundwater level, preferably under a covering sand layer of at least 30 cm.

(2) A coarse sand layer of around 5 cm may be provided under the capillary drainpipe band in order to enhance the effect of water collecting.

(3) The capillary drainpipe band is preferably arranged in an interlocking form, whereas the horizontal gap of the capillary drainpipe band depends on the groundwater level, the rain capacity and the permeability of the soil, etc.

(4) The capillary drainpipe band is connected to the pipelines, so that the water accumulated in the drainpipes can be drawn to pipelines and subsequently drained out.

Concluded above, the present invention, after completing the construction, can achieve the following advantages:

1. The construction of the environmental permeable flooring is very time-and-cost efficient.
2. The frame units not only can be used as positioning units, but also can be pre-colored such that when the concrete flooring is accomplished, the frame units can present the desired pattern without being further colored.
3. The water accumulated on the ground can be quickly drawn into the underground by the highly permeable flooring and further absorbed by the macadam base to enhance the water content of the soil and prevent heat island effect
4. The integral water resource recycling system can be constructed in a populous place, for example, a great community, the public, a metropolis, etc., so that the preserved water can be utilized in case of draught.
5. The integral water resource recycling system can allow the rain be drawn into the underground to supplement the groundwater content and prevent the groundwater from drying up and, in turn, the stratum from sagging.
6. After pre-burying the vertical overflow duct, water reservoirs, drainpipes and frame units in different stratum, such as, sand stratum, macadam base, permeable soil stratum, etc, the concrete may be applied to the ground and paved to construct impermeable flooring. Subsequently, the flooring may be drilled by special drilling devices to form permeable flooring for drawing the rain into the ground.

Concluded above, the present invention discloses a water resource recycling system with environmental permeable concrete flooring constructed in a planned way and efficiently. The system may prevent the city from floods and heat island effect, as well as the lack of water resource in draught. In addition, the water stored in the water reservoirs can be used in secondary utility such as fire distinguishing, watering road trees, maintaining roads, cleaning, the environment, serving engineering need, etc. In view of the novelty and environmental concept embraced by the present invention, as well as the value applicable to the filed, the inventor claims the invention as specified in the following claims.

The invention claimed is:

1. A water resource recycling system, characterized in that:

a. a vertical overflow duct extending deep into an impermeable stratum is provided by way of digging through a macadam base, the depth of the vertical overflow duct depends on the geology;

b. permeable and/or fast draining materials such as pebbles, sands, etc. can be filled in the vertical overflow duct;

c. water reservoirs pre-buried nearby the vertical overflow duct are respectively connected on an upper level portion thereof to the vertical overflow duct;

d. water-drawing pipes are provided for connecting the water reservoirs and the ground; and e. permeable flooring is provided above the macadam base such that the rain accumulated on the ground can be drawn into the underground quickly;

wherein the water reservoirs buried nearby the vertical overflow duct may be in the form of shallow level or high level such that the groundwater of different level can be collected therein.

2. The water resource recycling system according to claim 1, wherein each water reservoir is connected to the vertical overflow duct inside of which filters are provided.

3. The water resource recycling system according to claim 1, wherein a cap is provided on the outlet end of the water-drawing pipes connecting the water reservoirs and the ground.

4. The water resource recycling system according to claim 1, wherein the vertical overflow duct may be a pipe with a water-collecting cap provided on the tip, the water-collecting cap has water inlets which are covered by sand filtering elements.

5. The water resource recycling system according to claim 1, wherein the vertical overflow duct can be a pipe wit a plurality of water outlets on the wall such that the groundwater can be occasionally supplied to the underground.

6. The water resource recycling system according to claim 1, wherein a cap with air-vents can be provided on the outlet of each water-drawing pipe.

7. The water resource recycling system according to claim 1, wherein the water permeable flooring is constructed by pouring the concrete on the ground, paving the drying concrete to a flat flooring, and digging through the concrete layer by certain digging devices, thereby accomplishing the permeable flooring.

8. The water resource recycling system according to claim 1, wherein an overflow may be provided above the water reservoir.

9. The water resource recycling system according to claim 1, wherein capillary drainpipe band is provided on the vertical overflow duct or drainpipe; the capillary drainpipe band is pre-buried in the stratum to enhance draining out the water.

* * * * *